US005725214A

United States Patent [19]

Adams

[11] Patent Number: 5,725,214

[45] Date of Patent: Mar. 10, 1998

[54] FOUR HORSESHOE WIRE PUZZLE

[76] Inventor: Martin Adams, 351 Huntbourne Way NE, Calgary, AB, Canada, T2K 3Y3

[21] Appl. No.: 772,365

[22] Filed: Dec. 23, 1996

[51] Int. Cl.[6] ..... A63F 9/08

[52] U.S. Cl. ..... 273/158

[58] Field of Search ..... 273/158, 156, 273/153 R; D21/106, 107

[56] References Cited

U.S. PATENT DOCUMENTS

| | | | |
|---|---|---|---|
| 136,645 | 3/1873 | Ellis | 273/158 |
| D. 246,922 | 1/1978 | Heign | D34/15 M |
| D. 246,924 | 1/1978 | Heign | D34/15 M |
| D. 258,601 | 3/1981 | Smallwood | D21/106 |
| D. 275,775 | 10/1984 | Smith | D21/106 |
| D. 292,809 | 11/1987 | Kousman | D21/106 |
| 428,455 | 5/1890 | Charshee | 273/158 |
| 1,726,952 | 10/1929 | Gonzales | 273/158 |
| 2,162,278 | 6/1939 | Galeazzo | 273/156 |
| 3,441,282 | 4/1969 | Lewis | 273/158 |
| 4,497,489 | 2/1985 | Pelleti'er | 273/158 |
| 4,524,972 | 6/1985 | Wilmarth | 273/158 |
| 4,867,456 | 9/1989 | Weber | 273/158 |
| 4,878,670 | 11/1989 | Bernauer | 273/158 |
| 5,152,331 | 10/1992 | Mo | 273/158 |

FOREIGN PATENT DOCUMENTS

| | | | |
|---|---|---|---|
| 1189105 | 6/1985 | Canada | 273/158 |

*Primary Examiner*—Steven B. Wong
*Attorney, Agent, or Firm*—David S. Thompson

[57] ABSTRACT

A wire form puzzle is disclosed. The puzzle provides a dumbbell shaped capture element having a straight wire body having rings at the ends. An upper swing capture element provides a crescent shaped wire body having end rings attached to the straight wire body of the dumbbell shaped capture element. A lower swing capture element is similar to the upper swing, but smaller in size and is carried by the crescent shaped body of the upper swing. Four horseshoe shaped captured loops are carried by the lower swing capture element, but are removed from all the capture elements in the course of the puzzle's s solution. The horseshoe shaped loops have the characteristic of having a point, defined by the inner wire defining the horseshoe loop, that will pass into any of the rings, and also having the characteristic that the rings of the captive element will pass through the indentation between the legs of the horseshoes. The plurality of horseshoe loops challenges the user to perform the solution to the puzzle simultaneously on the left and right sides, wherein the movements solving the puzzle for different horseshoe loops are mirror images of each other. Also, the plurality of horseshoe loops allows the user to repeatedly perform portions of the solution of the puzzle, thereby mentally reinforcing the steps taken which result in the puzzle's solution.

1 Claim, 2 Drawing Sheets

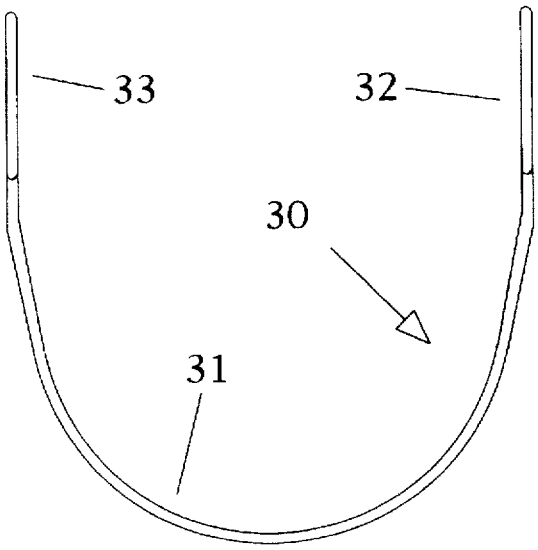
FIG. 4
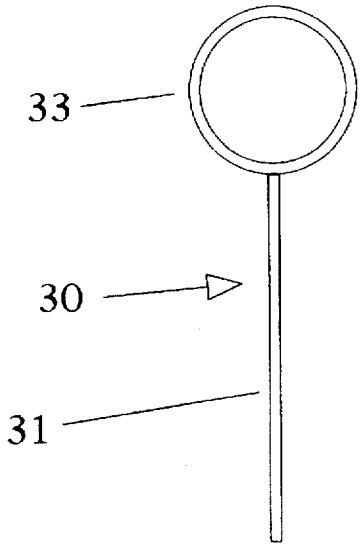
FIG. 5
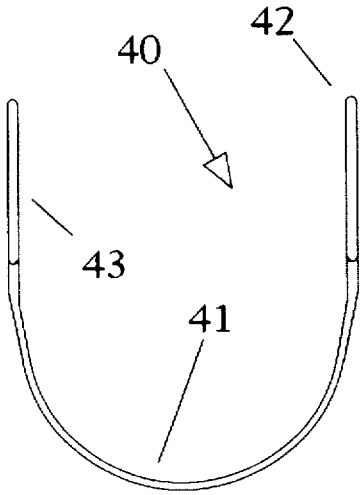
FIG. 6
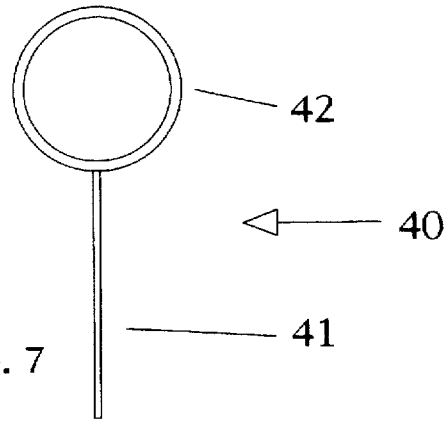
FIG. 7
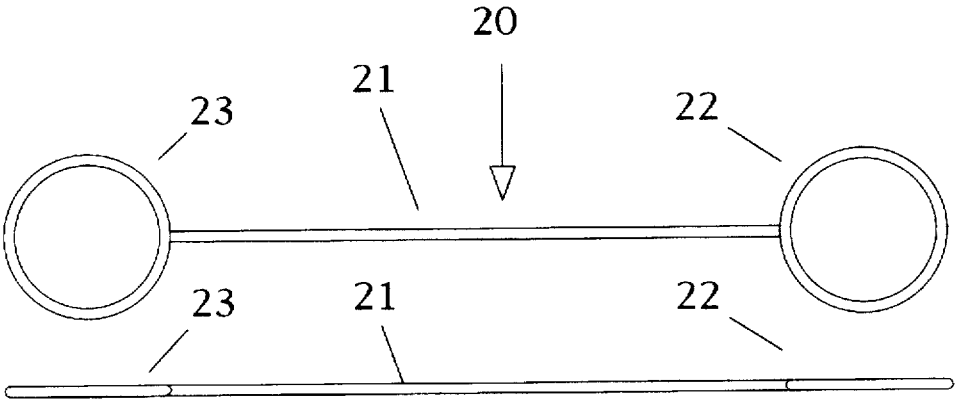
FIG. 8
FIG. 9

FOUR HORSESHOE WIRE PUZZLE

CROSS-REFERENCES

There are no applications related to this application filed in this or any foreign country.

BACKGROUND

Manipulatable wire puzzles having a captured loop member which must be manipulated in concert with a number of interconnected puzzle capture elements in order to separate the captured loop from the capture elements have existed in many forms for many years.

An early version of the captured loop wire puzzle is disclosed by Gonzales in U.S. Pat. No. 1,726,952, issued Sep. 3, 1929. The Gonzales puzzle disclosed a single captured loop member and a total of five interconnected puzzle capture elements.

A simpler design of a similar puzzle is seen in U.S. Pat. No. Des. 258,601, issued to James Smallwood, Jr. on Mar. 17, 1981. In this puzzle, a heart shaped captured loop member is separated from a total of three interconnected puzzle capture elements.

U.S. Pat. No. 4,497,489, issued to Wilmer Pelletier on Feb. 5, 1985, discloses a similar wire puzzle. This puzzle clearly illustrates the use of a captured member capable of being inserted through rings connecting the interconnected puzzle capture elements, and also capable of having the rings inserted through the captured member.

A further similar design of a puzzle having a captured heart and having two U-shaped and one dumbbell shaped puzzle capture elements is seen in U.S. Pat. No. 4,524,972, issued to Charles Wilmarth on Jun. 25, 1985. The Wilmarth patent provides a particularly detailed solution explaining the removal of the heart from the puzzle. This puzzle is also of the type wherein the heart may be maneuvered through the rings and where the rings may be moved through the heart.

A still further example of a variation of the captured heart wire puzzle is seen in U.S. Pat. No. 4,867,456, issued to Harold Weber et al. on Sep. 19, 1989. This puzzle is in almost every respect similar to the Wilmarth puzzle, but discloses the additional feature of a ring, carried by the heart, which adds a small measure of additional complexity to the solution.

The art in this area is clearly very well developed, and patents issued to many inventors since before 1900 illustrate the continuing fascination with every new variation on themes that have existed for decades. To satisfy the many puzzle enthusiasts, there is clearly a need for new variations of existing puzzles that are enjoyable both by those who are familiar with the earlier versions, and by those who are not.

SUMMARY

The present invention is directed to an apparatus that satisfies the above needs. A novel wire puzzle provides four horseshoe loops captured by three interconnected puzzle capture elements. An upper dumbbell-shaped capture element supports an upper swing capture element, which in turn supports a lower swing capture element. The four captured horseshoe loops are initially carried by the lower swing, but are removed in a sequential and optionally a mirror image manner as the puzzle is solved.

The four horseshoe wire puzzle of the present invention provides:

(a) An upper dumbbell-shaped capture element having a straight wire body supporting wire rings at each end of the body.

(b) An upper swing capture element provides a crescent or U-shaped wire body supporting wire rings at each end of the body. The wire rings both encircle the wire body of the upper dumbbell-shaped capture element. The wire rings of the dumbbell-shaped capture element prevent the upper swing from being released.

(c) A lower swing capture element provides a crescent or U-shaped wire body that is smaller than the upper swing. The wire body supports wire rings at each end of the body. The wire rings both encircle the wire body of the upper swing capture element. The wire rings of the upper swing prevent the lower swing from being released.

(d) Four identical horseshoe shaped loops are initially carried by the wire body of the lower swing. The horseshoe shaped loops have the characteristic that they are too big to be passed through the rings of any of the capture elements, and also that the rings of the capture elements may be passed through the interior of the horseshoe shaped loops and also through the indentation between the legs of the horseshoe.

It is therefore a primary advantage of the present invention to provide a novel wire puzzle having four horseshoe shaped wire loops captured by three manipulatable capture elements.

Another advantage of the present invention is to provide a wire puzzle having four captured horseshoe shaped loops, so that when one horseshoe loop is removed, if the user is unable to replace it, and it is lost, the puzzle will still function due to the presence of the other horseshoe shaped loops.

Another advantage of the present invention is to provide a wire puzzle having four captured horseshoe shaped loops, so that when the user succeeds in removing one horseshoe loop, that same process may be repeated three additional times, thereby solidifying the step sequence in the mind of the user. With only one captured element, the effort made in replacing that element often erases from the mind of the user the steps taken to remove it.

Another advantage of the present invention is to provide a wire puzzle having somewhat greater complexity than presently known wire puzzles, including the challenge of solving the puzzle wherein the movements solving the puzzle for different horseshoe loops are mirror images of each other.

A still further advantage of the present invention is to provide a wire puzzle having a captured horseshoe that will not fit through the ring members, as is the case with the puzzle disclosed in U.S. Pat. No. 4,524,972, and other similar puzzles, and that therefore requires a different solution.

DRAWINGS

These and other features, aspects, and advantages of the present invention will become better understood with regard to the following description, appended claims, and accompanying drawings where:

FIG. 4 is a front orthographic view of the upper swing capture element;

FIG. 5 is a side orthographic view of the upper swing of FIG. 4;

FIG. 6 is a front orthographic view of the lower swing capture element;

FIG. 7 is a side orthographic view of the lower swing of FIG. 6;

FIG. 8 is a front orthographic view of the dumbbell capture element; and

FIG. 9 is a top orthographic view of the dumbbell of FIG. 8.

DESCRIPTION

Figure 1:
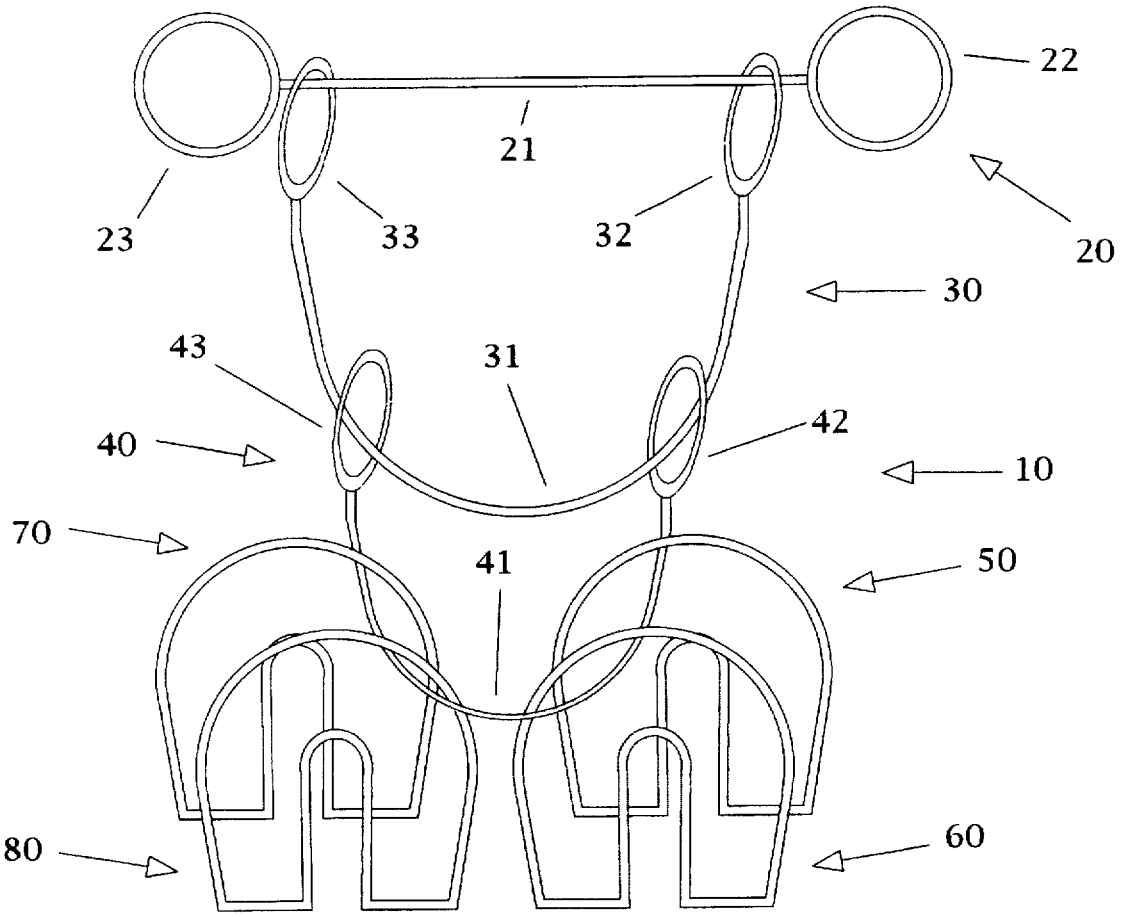
FIG. 1 is a view of the puzzle, including all three interconnected capture elements and all four captured horseshoe loops.

Referring in particular to FIG. 1, a four horseshoe wire puzzle 10 constructed in accordance with the principles of the invention is seen. A dumbbell capture element 20 supports a larger upper swing capture element 30 which in turn supports a smaller lower swing capture element 40. Four horseshoe shaped captured loops 50, 60, 7O, 80 are supported by the lower swing capture element 40 at the starting point of the puzzle.

Referring to FIGS. 1, 8 and 9, the dumbbell shaped capture element 20 is seen. The dumbbell shaped capture element is generally planar, having a straight wire body 21 having right and left ends carrying a right ring 22 and a left ring 23. In the preferred embodiment, the wire body 21 is approximately 3.75 inches long, but may be longer or shorter as desired. The left and right rings have a diameter of approximately 1 inch.

Referring to FIGS. 1, 4 and 5, the upper swing capture element 30 is seen. The upper swing capture element provides a crescent shaped wire body 31 having right and left ends carrying a right ring 32 and a left ring 33. The distance between the left and right ends of the wire body 31 is typically 3.25 inches. The length of the wire body 31 is typically 6 inches. The diameter of rings 32, 33 should be the same as the rings 22, 23, or about 1 inch. In the preferred embodiment, the planes in which the rings 32, 33 are located are typically perpendicular to the plane in which the wire body 31 is located.

Referring to FIGS. 1, 6 and 7, the lower swing capture element 40 is seen. The lower swing capture element provides a crescent shaped wire body 41 having right and left ends carrying a right ring 42 and a left ring 43. The distance between the left and right ends of the wire body 41 is typically 2 inches. The length of the wire body 41 is typically 3.75 inches. The diameter of rings 42, 43 should be the same as the rings 22, 23, 32, 33, or about 1 inch. In the preferred embodiment, the planes in which the rings 42, 43 are located are typically perpendicular to the plane in which the wire body 41 is located.

Figure 2:
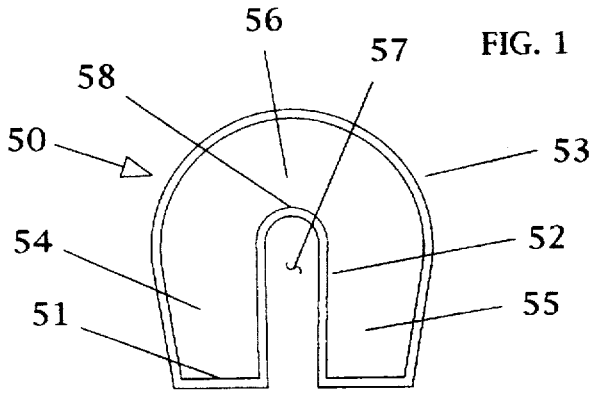
FIG. 2 is a view of one horseshoe loop.
Figure 3:
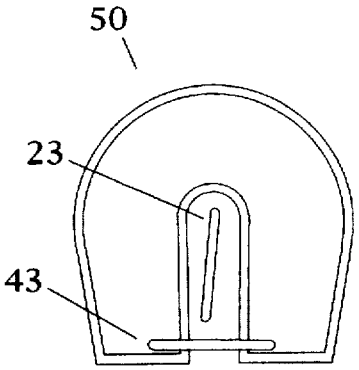
FIG. 3 is a view, for purposes of illustration of relative dimensions only, showing how the rings of the capture elements may be fit through the indentation between the legs of the horseshoe loops, and also how the point of the horseshoe loops may be fit through the rings of the capture elements.

Referring to FIGS. 1, 2 and 3, the four horseshoe shaped captured loops 5O, 60, 70, 80 are seen. Each horseshoe loop is similarly constructed. Referring to FIGS. 2 and 3 where horseshoe shaped loop 50 is illustrated, it can be seen that each loop provides an inner wire segment 52 and an outer wire segment 53, which are connected by left and right end wires 51, thereby forming left and right legs 54, 55 separated by a middle portion 56 and an indentation 57. The midpoint of the inner wire segment 52 defines a point 58. Typically, the horseshoe shaped captured loops are formed of a single length of wire, having ends joined together at a single location.

Referring in particular to FIG. 3, it can be seen that the distance between the inner wire segment and the outer wire segment is greater than the inside diameter of the left and right rings carried by the dumbbell capture element, the upper swing capture element and the lower swing capture element. Therefore the horseshoe loops may not be passed through rings 22, 23, 32, 33, 42, 43. This feature reduces the number of possible solutions to the puzzle. However, it can be seen that the point 58 of each horseshoe shaped loop is sized to allow clearance passage of any of the wire rings about the point 58. Also, it can be seen that the indentation 57 is sized to allow passage of any of the rings.

Referring to FIG. 1, the starting position of the puzzle is seen, wherein all horseshoe loops are located on the lower swing capture element 40. The steps involved in the solution will now be discussed. The first step to remove a first horseshoe loop from the puzzle is to hold the horseshoe parallel to the floor with point 58 pointed to the left, and then insert point 58 of the horseshoe loop through ring 43. Next, rings 23 and 33 are passed through indentation 57. Next, point 58 is inserted through ring 33. Ring 23 then passes through indentation 57. Point 58 is then removed from ring 43. This should cause the horseshoe loop to be totally separated from the lower swing capture element 40. The horseshoe loop is then held parallel to the floor, with the point 58 pointed to the left. The point 58 is then inserted into ring 33. Ring 23 is then passed downwardly through indentation 57. Ring 33 is then removed from point 58, thereby freeing the horseshoe loop.

To replace the horseshoe loop, the user first orients point 58 to point to the left, and then inserts point 58 into ring 33. Ring 23 is then passed through indentation 57. Point 58 is then withdrawn from ring 33. This should cause the horseshoe loop to be supported by the upper swing capture element 30. Point 58 is then directed to the left, and then inserted into ring 43. The point 58 is then maneuvered so that it may be pointed to the left as it is inserted into ring 33. Ring 23 is then passed downwardly through indentation 57. Ring 33 is then removed from point 58. Rings 33 and 23 are then passed through indentation 57. Ring 43 is then removed from point 58, thereby replacing the horseshoe loop in its starting position.

It is clear that while the above description is used when the point 58 of the horseshoe loop is pointed to the left, a similar description would allow removal and replacement of the horseshoe loop when the point 58 is directed to the right.

The previously described versions of the present invention have many advantages, including a primary advantage of providing a novel wire puzzle having four horseshoe shaped wire loops captured by three manipulatable capture elements.

Another advantage of the present invention is to provide a wire puzzle having four captured horseshoe shaped loops, so that when one horseshoe loop is removed, if the user is unable to replace it, and it is lost, the puzzle will still function due to the presence of the other horseshoe shaped loops.

Another advantage of the present invention is to provide a wire puzzle having four captured horseshoe shaped loops, so that when the user succeeds in removing one horseshoe loop, that same process may be repeated three additional times, thereby solidifying the step sequence in the mind of the user. With only one captured element, the effort made in replacing that element often erases from the mind of the user the steps taken to remove it.

Another advantage of the present invention is to provide a wire puzzle having somewhat greater complexity than presently known wire puzzles, including the challenge of solving the puzzle wherein the movements solving the puzzle for different horseshoe loops are mirror images of each other.

A still further advantage of the present invention is to provide a wire puzzle having a captured horseshoe that will not fit through the ring members, as is the case with the puzzle disclosed in U.S. Pat. No. 4,524,972, and other similar puzzles, and that therefore requires a different solution.

Although the present invention has been described in considerable detail and with reference to certain preferred versions, other versions are possible. For example, while in the preferred embodiment the construction of the puzzle is to be made of heavy wire, it may be preferred to construct the puzzle of light rod. Also, it is important to realize that the dimensions give are not critical, and the elements of the invention could be replaced with larger or smaller elements, as desired. Therefore, the spirit and scope of the appended claims should not be limited to the description of the preferred versions disclosed.

In compliance with the U.S. Patent Laws, the invention has been described in language more or less specific as to methodical features. The invention is not, however, limited to the specific features described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A wire-form puzzle, comprising:

(A) a generally planar dumbbell capture element comprising:

(a) a straight wire body having a left and a right end;

(b) a right ring, carried by the right end; and (c) a left ring, carried by the left end;

(B) an upper swing capture element, carried by the dumbbell capture element, comprising:

(a) a crescent shaped wire body having a left and a right end, the wire body having an overall length that is approximately 1.5 times the length of the straight wire body of the dumbbell capture element; and (b) a right ring, carried by the right end, the right loop engaging the straight wire body of the dumbbell capture element; and (c) a left ring, carried by the left end, the left loop engaging the straight wire body of the dumbbell capture element; and (C) a lower swing capture element, carried by the upper swing capture element, comprising:

(a) a crescent shaped wire body having a left and a right end, and having a length that is approximately equal to the length of the straight wire body of the dumbbell capture element;

(b) a right ring, carried by the right end, the right ring engaging the crescent shaped wire body of the upper swing capture element; and (c) a left ring, carried by the left end, the left ring engaging the crescent shaped wire body of the upper swing capture element, thereby allowing the lower swing capture element to be pivoted between a first position where the crescent shaped wire body is opposite the straight wire body of the dumbbell capture element and a second position where the crescent shaped wire body is adjacent to the straight wire body of the dumbbell capture element; and (D) four generally planar horseshoe shaped loops, initially carried by the lower swing capture element, each horseshoe shaped loop comprising an inner wire segment and an outer wire segment, the inner and outer wire segments connected by left and right end wires, thereby forming left and right legs separated by a middle portion and an indentation, wherein the distance between the inner wire segment and the outer wire segment is greater than an inside diameter of the left and right rings carried by the dumbbell capture element, the upper swing capture element and the lower swing capture element, and wherein a point formed by the inner wire segment of the horseshoe shaped loops is sized to allow clearance passage into any of the wire rings and wherein the indentation is sized to allow clearance passage by any of the wire rings.

* * * * *